US007270322B2

(12) United States Patent
Chikumoto

(10) Patent No.: US 7,270,322 B2
(45) Date of Patent: Sep. 18, 2007

(54) IMAGE FORMING APPARATUS

(75) Inventor: Kouichi Chikumoto, Osaka (JP)

(73) Assignee: Funai Electric Co., Ltd. (JP)

( * ) Notice: Subject to any disclaimer, the term of this patent is extended or adjusted under 35 U.S.C. 154(b) by 23 days.

(21) Appl. No.: 11/264,051

(22) Filed: Nov. 2, 2005

(65) Prior Publication Data

US 2006/0071401 A1 Apr. 6, 2006

(30) Foreign Application Priority Data

Apr. 11, 2004 (JP) ..... 2004-321037

(51) Int. Cl.
*B65H 3/52* (2006.01)

(52) U.S. Cl. ..... 271/121; 271/167

(58) Field of Classification Search ..... 271/121, 271/167, 104, 137

See application file for complete search history.

(56) References Cited

U.S. PATENT DOCUMENTS

| | | | | |
|---|---|---|---|---|
| 4,635,922 | A * | 1/1987 | Roetter et al. | 271/119 |
| 2006/0049573 | A1* | 3/2006 | Takasaka et al. | 271/121 |
| 2006/0071401 | A1* | 4/2006 | Chikumoto | 271/121 |

FOREIGN PATENT DOCUMENTS

| | | |
|---|---|---|
| JP | 07-126029 | 5/1995 |

* cited by examiner

*Primary Examiner*—David H Bollinger
(74) *Attorney, Agent, or Firm*—Bacon & Thomas, PLLC

(57) ABSTRACT

A paper feed portion for an image forming apparatus has a simple structure capable of generating a carrying force and preventing double feeding effectively. A paper feed roller 1 and a carrying auxiliary portion 2 are arranged symmetrically with respect to the paper feed path, that is, above the paper feed path on the upstream side and below the paper feed path on the downstream side, respectively. In the carrying auxiliary portion 2, a carrying force generating rib 22 is at the center of the width direction and positioned facing the contact member 10*a* of the paper feed roller 1. Double feed preventing ribs 23*a* and 23*b* are arranged symmetrically widthwise with respect to the carrying force generating rib 22. The upper surfaces 231*a* and 231*b* of the upstream ends of the double feed preventing ribs 23*a* and 23*b* are lower than the upper surface 221 of the upstream end of the carrying force generating rib 22, and the upper ends 233 of the wall surfaces of the upstream ends of the double feed preventing ribs 23*a* and 23*b* are positioned upstream of the upper end 223 of the wall surface of the paper carrying upstream end of the carrying force generating rib 22.

7 Claims, 5 Drawing Sheets

IMAGE FORMING APPARATUS

BACKGROUND OF THE INVENTION

1. Field of the Invention

The present invention relates to an image forming apparatus in which paper placed on a paper feed tray is fed into the main body to form an image thereon, and more particularly to a structure of a paper feed portion for such an image forming apparatus.

2. Description of the Prior Art

Conventionally, in an image forming apparatus such as a dye-sublimation printer, sheets of paper having a predetermined shape and placed on a paper feed tray are fed into the main body one by one to form an image thereon. In this case, it is necessary to feed only one sheet of paper from a stack of paper placed on the paper feed tray.

As shown in FIG. 5, in a conventional image forming apparatus are therefore provided a paper feed roller for feeding paper and carrying force generating ribs arranged on the downstream side of the paper feed roller, across the paper feed path, to apply a predetermined carrying force to paper.

A paper feed portion of a conventional image forming apparatus is shown in FIGS. 5 (*a*), (*b*) and (*c*) which are, respectively, a plan view, a side elevational view, and a partial perspective view of the paper carrying surface.

As shown in FIG. 5, the conventional paper feed portion comprises a paper feed roller 1 with an axis perpendicular to the paper feed direction as well as horizontal to the ground and a carrying auxiliary portion 2 with carrying force generating ribs 20*a* and 20*b* provided thereon and positioned on the paper carrying downstream side of and below the paper feed roller 1. The conventional paper feed portion applies a carrying force to paper between the carrying force generating ribs 20*a* and 20*b* and the contact members 10*a* and 10*b* on the paper feed roller 1. This allows the paper to be fed in a predetermined direction (indicated by the large arrow in FIG. 5). In this case, the height of the carrying force generating ribs 20*a* and 20*b* is preset to generate a predetermined carrying force and also to prevent double feeding (sheets of paper from being carried in an overlapped manner).

One device for generating a predetermined carrying force for paper and for preventing double feeding in a paper feeding apparatus comprises a placing table with a recessed portion contoured to the shape of a paper feed roller mounted therein (refer to Japanese Patent Laid-Open Publication No. Hei 7-126029 for example).

It is however difficult to set optimum conditions for generating a predetermined carrying force and for preventing double feeding in a paper feed portion of a conventional image forming apparatus having such a structure. That is, increasing the carrying force makes double feeding more likely, while configuring the structure to prevent double feeding reduces the carrying force.

Although there exists an apparatus in which the height of ribs can be varied to obtain optimum conditions for the generation of a carrying force and for the prevention of double feeding, it has a complex structure, resulting in an increase in cost.

SUMMARY OF THE INVENTION

Accordingly, it is an object of the present invention to provide an image forming apparatus having a simple structure capable of generating a required carrying force and preventing double feeding effectively.

The present invention is directed to an image forming apparatus for forming an image on paper fed by paper feed means, wherein the paper feed means comprises: a paper feed roller including a contact member to be brought into contact with paper while being rotated and a rotational member for transferring torque to the contact member; a carrying force generating rib arranged downstream of the paper feed roller within the paper feed path to apply a carrying force to paper together with the paper feed roller and having an upwardly extending first protrusion at an upstream end thereof, the first protrusion having an upper inclined surface; and a double feed preventing rib located downstream of the paper feed roller, transversely spaced from the contact member to prevent double feeding of paper and having an upwardly extending second protrusion at an upstream end thereof, the second protrusion having an upper inclined surface. The second protrusion is lower than the first protrusion. Its upper inclined surface has an inclination greater than that of the upper inclined surface of the first protrusion. Further, the upper end of the upper inclined surface of the second protrusion is arranged on the upstream side of the upper end of the upper inclined surface of the first protrusion.

With the above arrangement, the paper feed roller and the carrying force generating rib apply a carrying force to the paper in a predetermined direction.

In this case, the carrying force is set by the clearance between the paper feed roller and the inclined wall surface of the first protrusion. While with the thus set carrying force, multiple sheets of paper may be carried due to friction between them, here, due to the wall surface of the second protrusion of the double feed preventing rib having an inclination greater than that of the inclined wall surface of the first protrusion and second protrusion being arranged upstream of the first protrusion, sheets of paper are separated at the inclined wall surface of the second protrusion of the double feed preventing rib as well as at the upper end thereof.

The carrying force generating rib is arranged at approximately the center of the paper surface in the direction perpendicular to the paper feed direction, and a plurality of double feed preventing ribs are arranged in a symmetrical manner with respect to the carrying force generating rib in the direction perpendicular to the paper feed direction.

With the above arrangement, since a carrying force is applied to the center of the paper in the direction perpendicular to the paper feed direction, the paper cannot be carried while misaligned, at an angle to the carrying direction and double feeding is prevented at positions symmetrical with respect to the center position, whereby the downstream side end faces of sheets of paper separated are made to be perpendicular to the paper feed direction to prevent misalignment in the subsequent carrying operation.

The upper inclined wall surface of the second protrusion has an arc-shaped recess.

With above the arrangement, since the inclined wall surface of the second protrusion of the double feed preventing rib has an arc-shaped recess, sheets of separated paper are brought into contact with the arc-shaped face and thereby returned to their initial orientation easily.

In accordance with the present invention, it is possible to construct an image forming apparatus having a simple structure capable of generating a predetermined carrying force and of reliably preventing double feeding.

DESCRIPTION OF THE PREFERRED EMBODIMENTS

Here will be described a paper feed portion of an image forming apparatus according to an embodiment of the present invention with reference to FIGS. 1 to 4.

Figure 1:
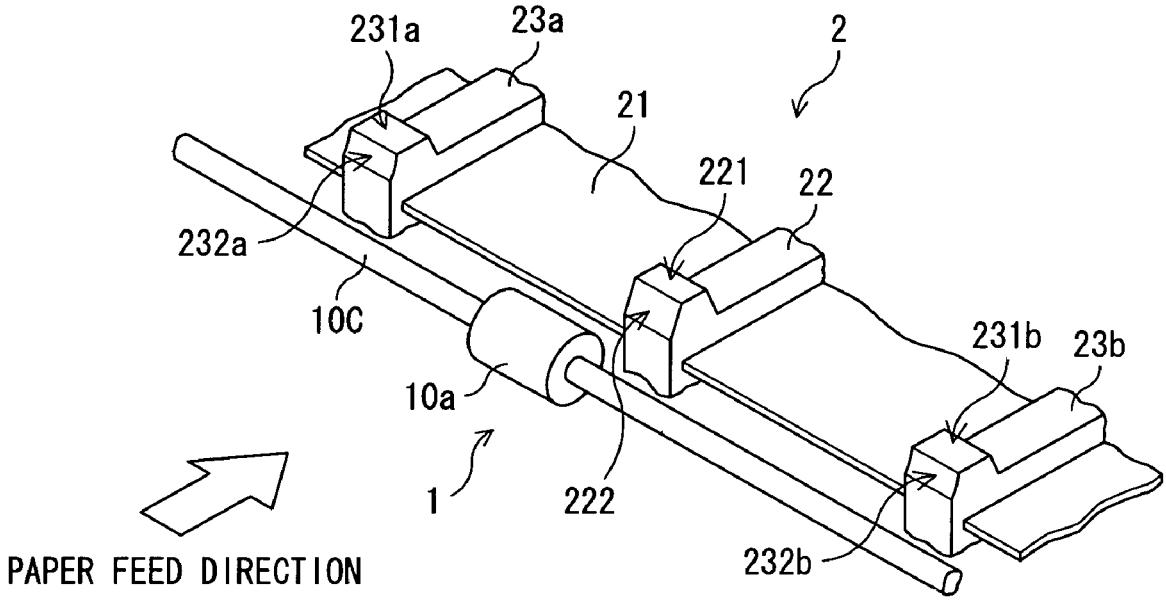
FIG. 1 is a perspective exterior view showing the schematic configuration of a paper feed portion of an image forming apparatus according to an embodiment of the present invention.
Figure 2A:
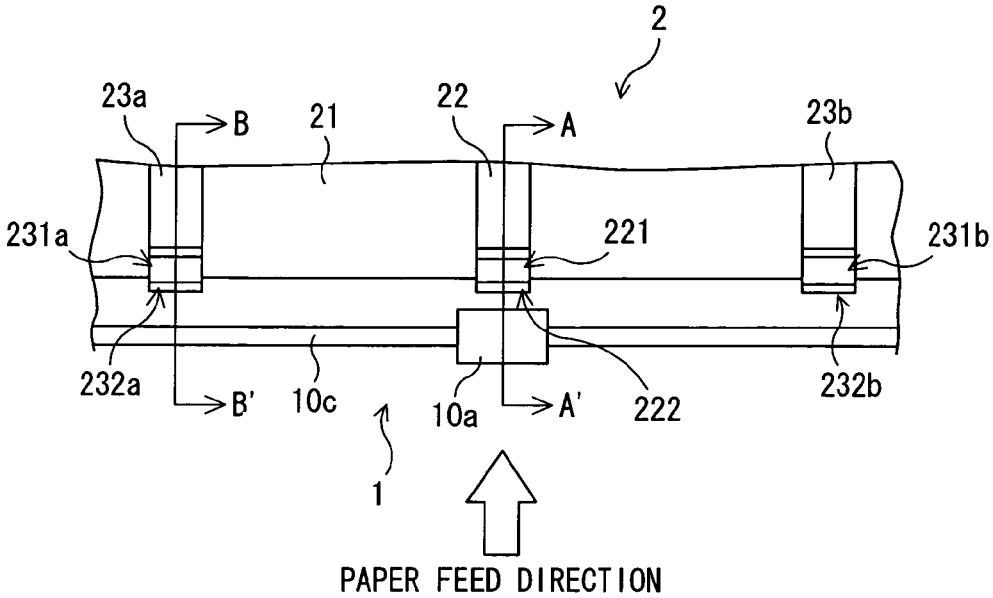
FIG. 2(*a*) is a plan view, FIG. 2(*b*) a cross-sectional view along the line A-A and FIG. 2(*c*) a cross-sectional view along the line B-B of the paper feed portion shown in FIG. 1.
Figure 2B:
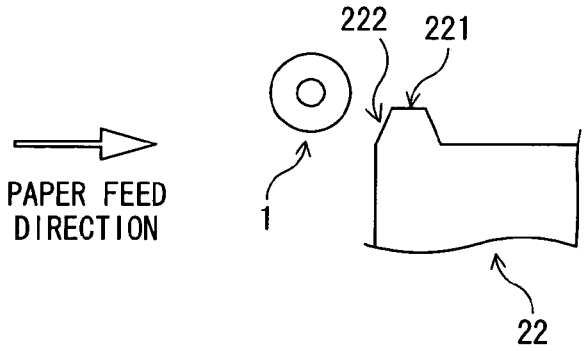
Figure 2C:
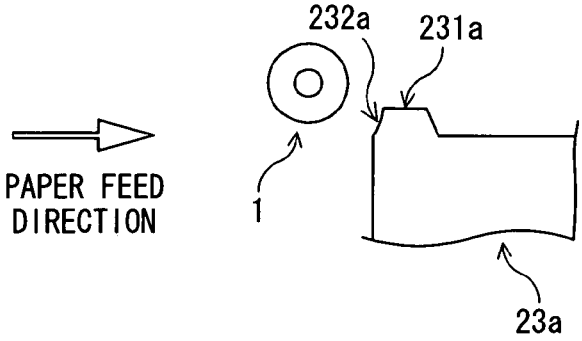
Figure 3:
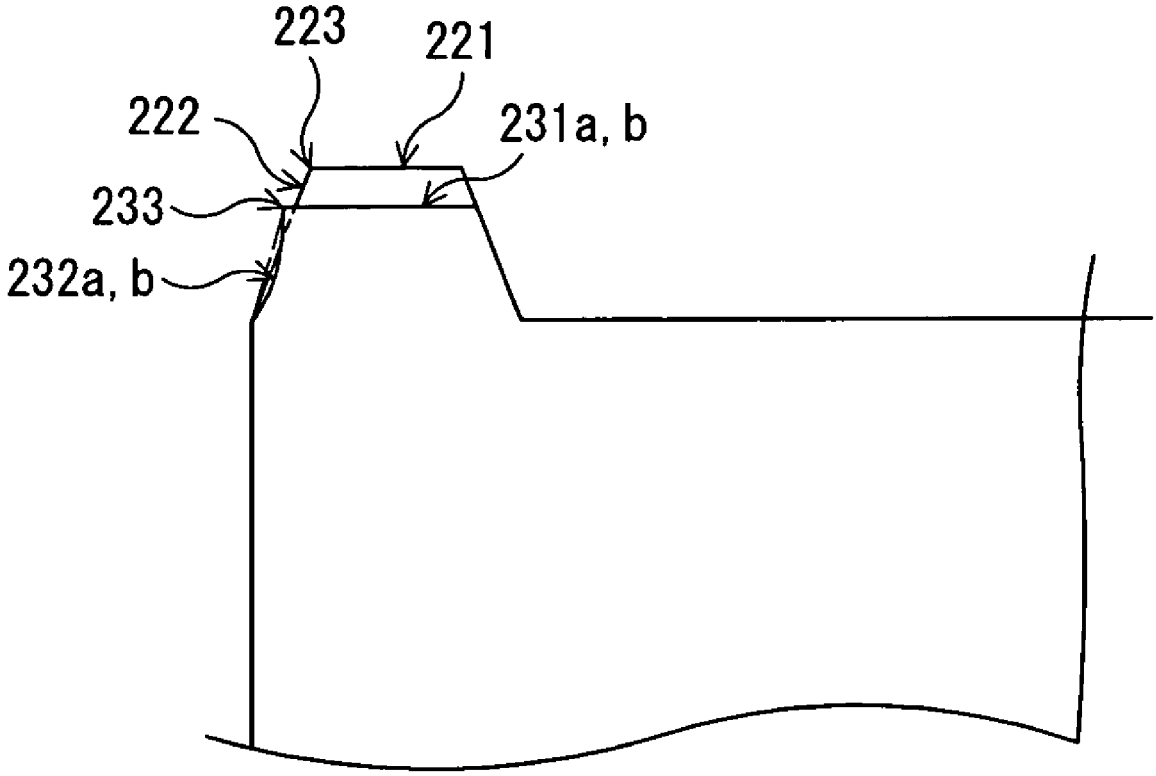
FIG. 3 is an elevational view showing the positional relationship between the carrying force generating rib and the double feed preventing ribs shown in FIGS. 1 and 2.

FIG. 1 is a partial perspective view showing the configuration of the paper feed portion of the image forming apparatus according to an embodiment of the present embodiment. Also, FIGS. 2 (*a*), (*b*) and (*c*) are, respectively, a plan view, a cross-sectional view along the line A-A and a cross-sectional view along the line B-B of the paper feed portion shown in FIG. 1. Further, FIG. 3 is an elevational view showing the positional relationship between the carrying force generating rib and the double feed preventing ribs shown in FIGS. 1 and 2.

The paper feed portion of the image forming apparatus according to the present invention comprises a paper feed roller 1 arranged above the paper feed path and a carrying auxiliary portion 2 arranged below the paper feed path.

The paper feed roller 1 consists of a rotational member 10*c* with an axis perpendicular to the paper feed direction of the image forming apparatus, that is, parallel to the width direction of the image forming apparatus, and a contact member 10*a* having a predetermined length as well as a predetermined diameter greater than that of the rotational member 10*c* and arranged at approximately the center of the width. On at least one end of the rotational member 10*c* is connected a drive unit (not shown in the figure) for rotating the rotational member 10*c*, the drive unit being adapted to rotatably drive the rotational member 10*c*, whereby the entire paper feed roller 1, including the contact member 10*a*, is rotated so that paper in contact with the contact member 10*a* is carried in a predetermined direction (paper feed direction).

The carrying auxiliary portion 2 integrally comprises: a base body 21; a carrying force generating rib 22 arranged at approximately the center of the width of the base body 21; and two double feed preventing ribs 23*a* and 23*b* arranged in a symmetrical manner with respect to the carrying force generating rib 22 in the width direction. The carrying auxiliary portion 2 is arranged below the paper feed path and in a position approximately symmetrical with the paper feed roller 1 across the paper feed path, and is mounted in the main body (chassis) of the image forming apparatus (not shown in the figure). In this case, the carrying auxiliary portion 2 is arranged on the paper path downstream side (indicated by the thick arrow in the figure) of the paper feed roller 1, and the upper ends of the ribs 22, 23*a* and 23*b* are positioned higher than the lower end of the contact member 10*a* of the paper feed roller 1.

The carrying force generating rib 22 comprises an approximately rectangular parallelepiped-shaped base having a predetermined width in the width direction of the image forming apparatus as well as a predetermined length in the paper feed direction, and a protrusion extending upwardly from the base at an end closest to the paper feed roller 1, i.e. the paper carrying upstream side end. An inclined wall surface 222 of the protrusion at the paper carrying upstream side end is joined, at a predetermined angle, to a lower vertical wall surface. The protrusion also has an upper surface 221 that is flat and horizontal. The carrying force generating rib 22 is centered relative to the axial dimension of the contact member 10*a* on the paper feed roller 1.

The double feed preventing ribs 23*a* and 23*b* each comprise a base portion having approximately the same shape as the carrying force generating rib 22, and a protrusion extending upward from the base portion at an upstream end thereof, similar to the carrying force generating rib 22. The wall surfaces 232*a* and 232*b* at the paper carrying upstream side ends of the ribs 23 and 23*b* are inclined at a predetermined angle with respect to the lower vertical face, and have an arc-shaped recess. The upper surfaces 231*a* and 231*b* of the paper carrying upstream side end portions are formed flat horizontally, and the upper surfaces 231*a* and 231*b* of the two double feed preventing ribs 23*a* and 23*b* are arranged at the same height. The upper surfaces 231*a* and 231*b* of the double feed preventing ribs 23*a* and 23*b* are lower than the upper surface 221 of the carrying force generating rib 22. In addition, the double feed preventing ribs 23*a* and 23*b* are arranged in a transversely symmetrical manner with respect to the carrying force generating rib 22.

Also, the upper ends 233 of the wall surfaces 232*a* and 232*b* of the double feed preventing ribs 23*a* and 23*b* are arranged on the paper carrying upstream side of the upper end 223 of the wall surface 222 of the carrying force generating rib 22, and the inclination of the wall surfaces 232*a* and 232*b* of the double feed preventing ribs 23*a* and 23*b* is greater than that of the wall surface 222 of the carrying force generating rib 22.

The paper feed portion of thus arranged image forming apparatus feeds paper in accordance with the operation to be described hereinafter with reference to FIGS. 4(*a*)-4(*c*).

Figure 4A:
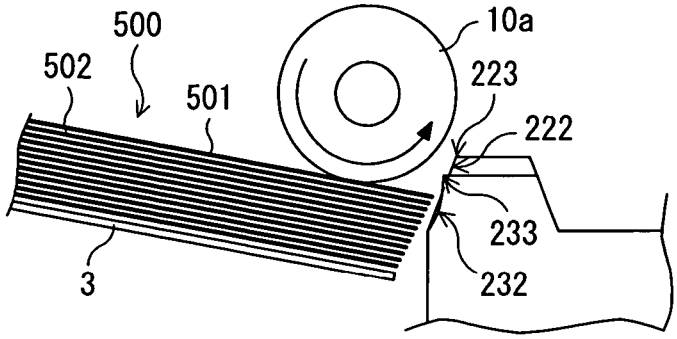
FIG. 4 is a schematic view showing the paper feed operation of the paper feed portion of the image forming apparatus according to the embodiment of FIG. 1.
Figure 4B:
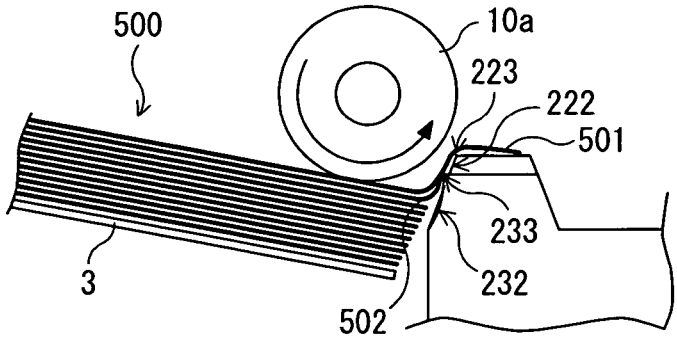
Figure 4C:
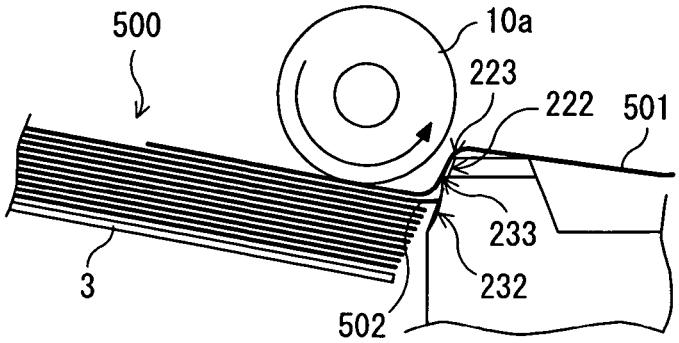
Figure 5A:
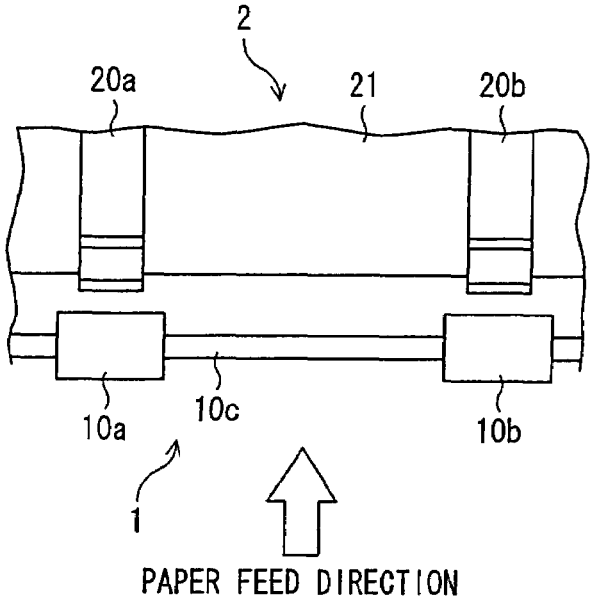
FIG.5(a) (PRIOR ART)
FIG. 5(*a*) is a plan view, FIG. 5(*b*) a side elevational view, and FIG. 5(*c*) a partial perspective view of a paper feed portion of a conventional image forming apparatus.
Figure 5B:
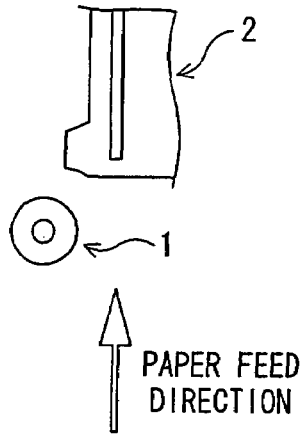
FIG.5(b) (PRIOR ART)
Figure 5C:
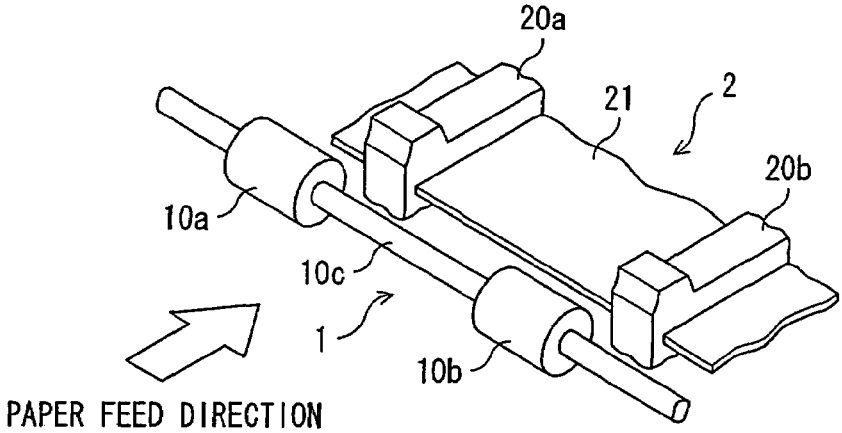
FIG.5(c) (PRIOR ART)

First, at the start of printing, that is, paper feed operation, the contact member 10*a* of the paper feed roller 1 is brought into contact with the top paper 501 of the group of multiple sheets of paper 500 placed on a paper placing table 3 as shown in FIG. 4 (*a*). At the same time, the paper feed roller 1 rotates in such a manner as to carry the paper 501 toward the carrying force generating rib 22 and the double feed preventing ribs 23*a* and 23*b*. The contact member 10*a* of the paper feed roller 1 is made of a material that generates a predetermined friction against the paper 501, and therefore the rotation of the paper feed roller 1 (contact member 10*a*) causes the paper 501 to be carried toward the ribs 22, 23*a* and 23*b*, that is, in the paper carrying downstream direction. In this case, since the paper 501 also has a predetermined friction against the paper 502, the carrying of the paper 501 causes the paper 502 to be carried in the same direction.

Next, as the rotation of the paper feed roller 1 continues, the paper 501 is carried in accordance with the amount of the rotation, and the leading end thereof is brought into contact with the wall surface 222 on the paper carrying upstream side of the carrying force generating rib 22 and with the wall surfaces 232 (232*a* and 232*b*) on the paper carrying upstream side in the double feed preventing ribs 23*a* and 23*b* and is carried along the wall surfaces 222, 232*a* and 232*b*. Since the paper 501, which is in direct contact with the contact member 10*a* of the paper feed roller 1, receives a predetermined amount of carrying force from the contact member 10*a* and the carrying force generating rib 22, the paper 501 is carried continuously in the paper carrying downstream direction without any affect thereon, even when brought into contact with the upper ends 233 of the wall surfaces 232*a* and 232*b* on the paper carrying upstream side in the double feed preventing ribs 23*a* and 23*b*, as shown in FIG. 4 (*b*). Meanwhile, the downstream side leading end of the paper 502, which is not in direct contact with the contact member 10*a* of the paper feed roller 1, runs head-on into the contact regions between the upper ends 233 of the wall surfaces 232 of the double feed preventing ribs 23*a* and 23*b*, which are on the upstream side of the wall surface 222 of the carrying force generating rib 22, and with the reverse side of the paper 501 (not in contact with the contact member 10*a* of the paper feed roller 1). In this case, since the wall surfaces 232*a* and 232*b* on the upstream side of the double feed preventing ribs 23*a* and 23*b* have a greater inclination, these wall surfaces function as a stopper preventing transport of the paper 502. Therefore, the paper 502 cannot be carried downstream beyond that point.

Then, even as the paper 501 is carried further downstream, the leading end of the paper 502 runs head-on into the arc-shaped wall surfaces 232 and thereby falls back into the position where it was at the start of paper feeding, as shown in FIG. 4 (*c*).

The above arrangement provides a paper feed portion having a simple structure which generates a predetermined carrying force and prevents double feeding.

Next will be described an image forming apparatus comprising such a paper feed portion. It should be noted that the following description is based on a dye-sublimation printer as an example of an image forming apparatus.

The dye-sublimation printer is for printing color images in which an ink ribbon is tightly stretched across a thermal head, the ink ribbon being fed from the paper feed side and reeled up at the paper discharge side. The ink ribbon is a combination of ink ribbons of cyan, magenta and yellow in this order. The length of each color ink ribbon is the same as the longest dimension of paper on which a color image is to be printed.

When a color image to be printed is input to the dye-sublimation printer, color separation of the input color image is effected to generate cyan, magenta, and yellow images. In the dye-sublimation printer, the paper feed portion as described above feeds paper 501, supported on a paper placing table (paper feed tray) 3 in a stack (multiple sheets) of paper 500, between the platen roller and the thermal head with the leading end of the cyan ink ribbon being aligned with that of the paper 501 just upstream of the thermal head. When the leading end of the paper 501 reaches the printing position adjacent the thermal head, the printing press lever is rotated to press the thermal head toward the platen roller with a sufficient pressing force. The paper 501 is carried using a paper carrying mechanism to where the ink ribbon and the paper 501 overlap each other between the thermal head and the platen roller. Then, the paper carrying mechanism carries the paper 501 continuously, and the ink ribbon is reeled up at the paper discharge side. When the rear end of the paper 501 reaches the printing position adjacent the thermal head, the transport of the paper 501 and the reeling of the ink ribbon are stopped, and the press lever is rotated to release the pressing force of the thermal head against the platen roller. Thus, the printing of a cyan image is completed prior to start of the step of printing a magenta image over the cyan image.

In the state above, only the paper 501 is returned to the paper feed side by the paper carrying mechanism, and is again fed between the platen roller and the thermal head with the leading end of the magenta ink ribbon being aligned with that of the paper 501. When the leading end of the paper 501 reaches the printing position adjacent the thermal head, the printing press lever is rotated to press the thermal head toward the platen roller with a sufficient pressing force. The paper 501 is carried using the paper carrying mechanism in this state, where the ink ribbon and the paper 501 are overlapped with each other between the thermal head and the platen roller. Then, the paper carrying mechanism continues to carry the paper 501, and the ink ribbon is reeled at the paper discharge side. When the rear end of the paper 501 reaches the printing position adjacent the thermal head, the transport of the paper 501 and the reeling of the ink ribbon are stopped, and the press lever is rotated to release the pressing force applied between the thermal head and the platen roller. Thus, the printing of a magenta image is completed prior to start of the step of printing a yellow image over the magenta image.

Next, as in the step of printing the foregoing magenta image, only the paper 501 is returned to the paper feed side by the paper carrying mechanism, and fed between the platen roller and the thermal head with the leading end of the yellow ink ribbon being aligned with that of the paper 501. When the leading end of the paper 501 reaches the printing position adjacent the thermal head, the printing press lever is rotated to press the thermal head against the platen roller with a sufficient pressing force. The paper 501 is carried using the paper carrying mechanism while in the state where the ink ribbon and the paper 501 are overlapped with each other between the thermal head and the platen roller. Then, the paper carrying mechanism continues to carry the paper 501, and the ink ribbon is reeled at the paper discharge side. When the rear end of the paper 501 reaches the printing position adjacent the thermal head, the transport of the paper 501 and the reeling of the ink ribbon are stopped, and the press lever is rotated to release the pressing force between the thermal head and the platen roller. Thus, the printing of a yellow image and therefore a color image is completed.

Such a paper feed portion as described above, incorporated into image forming apparatus, allows paper to be fed properly without double feeding. Thus, it is possible to construct an image forming apparatus having a simple structure capable of preventing defective paper feeding and of reducing defective printing due to double feeding.

The invention claimed is:

1. An image forming apparatus for forming an image on paper fed by paper feed means along a paper feed path extending upstream in a paper feed direction and having a transverse dimension perpendicular to the paper feed direction, wherein said paper feed means comprises:

a paper feed roller including a contact member for contact with the paper and a rotational member for rotatably driving the contact member;

a carrying force generating rib arranged downstream of said paper feed roller, at approximately the center of the transverse dimension of the paper feed path, for applying a carrying force to the paper in cooperation with said paper feed roller, said carrying force generating rib having an upwardly extending first protrusion at an upstream end thereof, said first protrusion having an upper inclined surface; and a pair of double feed preventing ribs, located downstream of said paper feed roller, transversely spaced from said contact member and in positions symmetrical with respect to said carrying force generating rib, for preventing double feeding of paper, each of said double feed preventing ribs having an upwardly extending second protrusion at an upstream end thereof, each of said second protrusions having an upper inclined surface with an arc-shaped recess; and wherein the inclination of the upper inclined surfaces of said second protrusions is greater than the inclination of the upper inclined surface of said first protrusion; and wherein upper inclined surfaces of said second protrusions terminate at upper edges located upstream of an upper edge where the inclined surface of said first protrusion terminates.

2. The image forming apparatus according to claim 1, wherein said first protrusion extends higher than said second protrusions.

3. An image forming apparatus for forming an image on paper fed by paper feed means along a paper feed path extending upstream in a paper feed direction and having a transverse dimension perpendicular to the paper feed direction, wherein said paper feed means comprises:

a paper feed roller including a contact member for contact with the paper and a rotational member for rotatably driving the contact member;

a carrying force generating rib arranged downstream of said paper feed roller, at approximately the center of the transverse dimension of the paper feed path, for applying a carrying force to the paper in cooperation with said paper feed roller, said carrying force generating rib having a first upstream end portion with an inclined surface; and a double feed preventing rib located downstream of said paper feed roller, transversely spaced from said contact member for preventing double feeding of paper, said double feed preventing rib having a second upstream end portion with an inclined surface; and wherein the inclination of the inclined surface of said second upstream end portion is greater than the inclination of the inclined surface of said first upstream end portion; and wherein the inclined surface of said second upstream end portion terminates at an upper edge located upstream of an upper edge where the inclined surface of said first upstream end portion.

4. The image forming apparatus according to claim 3, wherein said carrying force generating rib is arranged at approximately the center of the transverse dimension; and a plurality of said double feed preventing ribs are arranged transversely symmetrical relative to said carrying force generating rib.

5. The image forming apparatus according to claim 4 wherein the inclined surface of said second upstream side end portion has an arc-shaped recess.

6. The image forming apparatus according to claim 3, wherein the inclined surface of said second upstream side end portion has an arc-shaped recess.

7. The image forming apparatus according to claim 3, wherein said first protrusion extends higher than said second protrusion.

* * * * *

UNITED STATES PATENT AND TRADEMARK OFFICE

CERTIFICATE OF CORRECTION

PATENT NO. : 7,270,322 B2
APPLICATION NO. : 11/264051
DATED : September 18, 2007
INVENTOR(S) : Kouichi Chikumoto It is certified that error appears in the above-identified patent and that said Letters Patent is hereby corrected as shown below:

Column 8, line 13 (claim 3, penultimate line), “where” should read -- of --.

Signed and Sealed this

Fourth Day of March, 2008

JON W. DUDAS
*Director of the United States Patent and Trademark Office*